US010000869B2

(12) United States Patent
Egawa et al.

(10) Patent No.: US 10,000,869 B2
(45) Date of Patent: Jun. 19, 2018

(54) INDUSTRIAL TWO-LAYERED FABRIC

(71) Applicant: NIPPON FILCON CO., LTD., Inagi-shi, Tokyo (JP)

(72) Inventors: Toru Egawa, Fuji-shi Shizuoka (JP); Fumihito Takahashi, Fuji-shi Shizuoka (JP)

(73) Assignee: NIPPON FILCON CO., LTD., Tokyo (JP)

( * ) Notice: Subject to any disclaimer, the term of this patent is extended or adjusted under 35 U.S.C. 154(b) by 106 days.

(21) Appl. No.: 15/123,416

(22) PCT Filed: Mar. 4, 2014

(86) PCT No.: PCT/JP2014/055359
§ 371 (c)(1),
(2) Date: Sep. 2, 2016

(87) PCT Pub. No.: WO2015/132867
PCT Pub. Date: Sep. 11, 2015

(65) Prior Publication Data

US 2016/0369432 A1 Dec. 22, 2016

(51) Int. Cl.
*D03D 1/00* (2006.01)
*D03D 11/00* (2006.01)

(52) U.S. Cl.
CPC ..... *D03D 11/00* (2013.01); *D10B 2401/062* (2013.01); *D10B 2505/00* (2013.01)

(58) Field of Classification Search
CPC ..... D03D 11/00; D03D 2505/00; D10B 2401/062
See application file for complete search history.

(56) References Cited

U.S. PATENT DOCUMENTS 5,135,802 A 8/1992 Gstrein et al.
7,108,019 B2 9/2006 Nagura et al.
(Continued)

FOREIGN PATENT DOCUMENTS

JP 1981-084566 12/1982
JP 2558154 B2 3/1990
(Continued)

OTHER PUBLICATIONS

Notification of Receipt of Search Copy issued in Application No. PCT/EP2014/055359 dated Mar. 18, 2014 (1 page).
(Continued)

*Primary Examiner* — Arti Singh-Pandey
(74) *Attorney, Agent, or Firm* — Flynn, Thiel, Boutell & Tanis, P.C.

(57) ABSTRACT

An industrial two-layered fabric comprising an upper surface side fabric having an upper surface side warp and at least an upper surface side weft, and a lower surface side fabric comprising at least a lower surface side warp and at least a lower surface side weft bound by at least an upper surface side biding yarn and at least a lower surface side binding yarn, said industrial two-layered fabric is constituted by at least first pair of warps in which the upper surface side warp and the lower surface side warp are vertically arranged, at least second pair of warps in which the upper surface side binding yarn functioning as a binding yarn and the lower surface side binding yarn functioning as a binding yarn are vertically arranged, and at least third pair of warps where two upper surface side warps are adjacently arranged, said industrial two-layered fabric further comprises at least an auxiliary weft which isn't exposed to a surface of the fabric without being woven with any warp.

7 Claims, 3 Drawing Sheets

(56) References Cited

U.S. PATENT DOCUMENTS

| | | | |
|---|---|---|---|
| 2003/0217782 | A1 | 11/2003 | Nagura et al. |
| 2014/0020786 | A1 | 1/2014 | Usuki |

FOREIGN PATENT DOCUMENTS

| | | | |
|---|---|---|---|
| JP | 3425605 | B2 | 5/2003 |
| JP | 2003-342889 | A | 12/2003 |
| JP | 2008-138309 | A | 6/2008 |
| JP | 2009-155747 | A | 7/2009 |
| WO | WO 2012/140992 | A1 | 10/2012 |

OTHER PUBLICATIONS

Notification of Transmittal of International Search Report issued in Application No. PCT/EP2014/055359 dated Jun. 17, 2014 (2 pages).

International Search Report issued in Application No. PCT/JP2014/055359 with English translation dated Jun. 17, 2014 (5 pages).

Written Opinion of International Searching Authority issued in Application No. PCT/JP2014/055359 dated Jun. 17, 2014 (3 pages).

INDUSTRIAL TWO-LAYERED FABRIC

TECHNICAL FIELD OF THE INVENTION

The present invention relates to an industrial two-layered fabric which is capable of restricting the sticking of fibers to improve a lateral rigidity, a diagonal rigidity, a sheet-supportability, in particular, relates to an industrial two-layered fabric which is capable of attaining an excellent permeability and an excellent surface density, while at the same of improving a rigidity to restrict a curl of the fabric in its widthwise direction.

BACKGROUND ART

Conventionally, a plurality of methods of producing industrial multi-layered fabric are widely known. For example, in a so-called span-bond method, requirements such as a lateral rigidity, a diagonal rigidity, and a sheet supportability are needed in the industrial multi-layered fabric. Since the industrial fabric is laterally moved during its running, for a machine for producing the industrial fabric, a palm needs to be applied to the industrial fabric to restrict its movement. Such being the case, in a case where the lateral rigidity of the industrial fabric used is low, a technical problem that the industrial fabric is folded due to the interference by the palm can rise.

In addition, permeability required for the industrial fabric needs to be appropriately set, in accordance with the fabric to be woven. If the permeability is too high, the fiber can be removed off, while if it is too low, More specifically, a fabric shown in FIG. 19 in Patent Publication 1 was adopted as a conventional fabric. Although such conventional fabric exhibits an excellent permeability at the beginning of its use, a technical problem that the fibers gets stuck into the fabric with time due to its repeated use for producing non-woven fabric has arisen. Here, a sticking phenomenon is defined to a phenomenon in which the fibers are caused to enter into between intersections of knuckles of wires. If the sticking of the fibers are caused, technical problems that the wires mates with the non-woven fibers, or that the permeability of the fabric is increased can rise.

In addition, generally, the knuckle connected to a single yarn tends to have a strong intersection supporting force, while, the knuckle connected to a plurality of yarns tends to have a weak intersection supporting force. For this reason, a structure in which the intersection supporting force is the strongest is a plain weaving structure. In the plain weaving structure, since each of all the knuckles constitutes the one connected to a single yarn, the knuckle density is the highest.

However, in the general industrial fabric, since the surface density gets decreased if the diameter of the wefts is enlarged, so that the lateral density and the surface density are not convertible. That is why it is technically difficult to produce the plain weaving structure.

In order to solve such technical problem, the non-woven multi-layered fabric which exhibits the good permeability, the good lateral rigidity, good sticking of the fiber, the good surface density, the good diagonal rigidity, and the good sheet supportability was devised (Patent Publication 2).

On the other hand, the fabric is formed by weaving wefts and warps with each other. A shape of each of the woven yarns is caused to vary due to the fact that it is folded or bent in every direction. In addition, since a tension force is applied to the warp when the fabric is thermally processed, the woven yarns tend to largely deform in the weft direction. In other words, it is well known that the fabric can curl in its widthwise direction.

Further, various kinds of yarns constituting the fabric are known. For instance, the material of the yarn can be selected freely and usable examples of it include polyester, polyamide, polyphenylene sulfide, polyvinylidene fluoride, polypropylene, aramid, polyether ketone, polyethylene naphthalate, and polytetrafluoroethylene. However, in a case where such above yarns are adopted for the fabric, the fabric tends to curl in its widthwise direction due to the fact that the yarns can shrink upon the thermal process of the fabric. In addition, in the two-layered fabric, the diameter of the upper surface side fabric can be different from that of the lower surface side of the fabric, or the number of the upper surface side fabric can be different from that of the lower surface side of the fabric.

Under such circumstances, the fabric can readily curl in its widthwise direction due to the fact that the shrinking force of the upper surface side fabric differs from that of the lower surface side fabric.

Such a technical problem of the curling of the fabric can rise in the non-woven multi-layered fabric disclosed in the Patent Publication, and an effective means for solving such a technical problem has not been found so far.

Patent Publication 1: Japanese Patent No. 2558154

Patent Publication 2: WO/2012/140992

DISCLOSURE OF THE INVENTION

Technical Problems to be Solved by Present Invention

An object of the present invention is to provide an industrial two-layered fabric is capable of restricting the sticking of fibers to improve a lateral rigidity, a diagonal rigidity, a sheet-supportability, while at the same time of maintain a good permeability and a good surface density on the upper surface side fabric so as to attain an excellent permeability and improve a rigidity to restrict a curl of the fabric in its widthwise direction.

Means to Solve Technical Problems

The industrial two-layered fabric of the present invention solve the technical problem of sticking of fibers to improve a, permeability, a lateral rigidity, a diagonal rigidity, a sheet-supportability, and a rigidity, and to restrict a curl of the fabric in its widthwise direction.

In order to solve the above technical problems, the present inventor adopted the following structure.

1. An industrial two-layered fabric comprising an upper surface side fabric comprising at least an upper surface side warp and at least an upper surface side weft, and a lower surface side fabric comprising at least a lower surface side warp and at least a lower surface side weft bound by at least an upper surface side biding yarn and at least a lower surface side biding yarn, said industrial two-layered fabric is constituted by at least first pair of warps in which the upper surface side warp and the lower surface side warp are vertically arranged, at least second pair of warps in which the upper surface side binding yarn functioning as a binding yarn and the lower surface side binding yarn functioning as a binding yarn are vertically arranged, and at least third pair of warps in which two upper surface side warps are adjacently arranged, said industrial two-layered fabric further comprises at least an auxiliary weft which is not exposed to a surface of the fabric without being woven with any warp.

2. The industrial two-layered fabric according to any of claim 1, wherein a structure of each of the upper and lower surface side fabrics is constituted by a plain weaving.
3. The industrial two-layered fabric according to claim 1 or 2, wherein at least a portion of or all of said first pair of warps is formed by carbon line.
4. The industrial two-layered fabric according to any of claims 1 to 3, wherein ends in the warp direction of the industrial two-layered fabric are connected by a loop joint to form an endless configuration.
5. The industrial two-layered fabric according to any of claims 1 to 4, wherein the difference of the diameter between the upper surface side weft and the lower surface side weft is set to be within ±20% of the diameter of the upper surface side weft.
6. The industrial two-layered fabric according to any of claims 1 to 5, wherein a complete structure of the industrial two-layered fabric is formed by sixteen warps in which four sets of the first pair of warps, two sets of the second pair of warps and two sets of the third pair of binding yarns warps are included.
7. The industrial two-layered fabric according to any of claims 1 to 5, wherein a complete structure of the industrial two-layered fabric is formed by twenty warps in which six sets of the first pair of warps, two sets of the second pair of warps and two sets of the third pair of binding yarns warps are included.

Effect of the Invention

The industrial two-layered fabric of the present invention can restrict the sticking of fibers to improve a lateral rigidity, a diagonal rigidity, a sheet-supportability, in particular, attain an excellent permeability and an excellent surface density.

In addition, the industrial two-layered fabric of the present invention can further improve a rigidity to restrict a curl of the fabric in its widthwise direction.

DETAILED DESCRIPTION OF THE INVENTION

Figure 1:
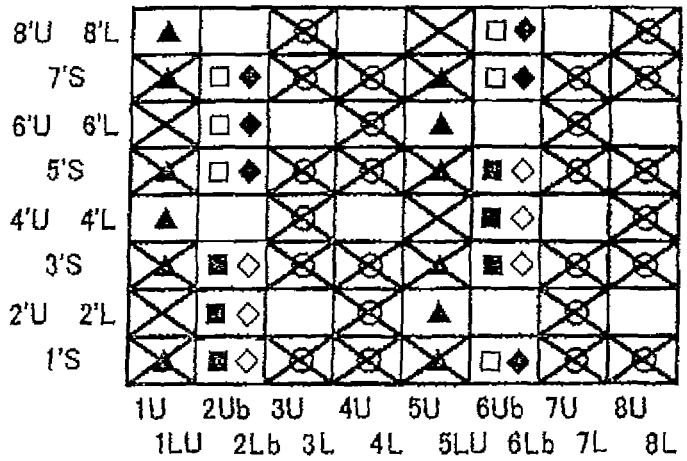
FIG. 1 is a design view showing a complete structure of the industrial two-layered fabric of the first embodiment according to the present invention.

The structure and the effect of the industrial two-layered fabric of the present invention will be explained about below, and then, the embodiment of the industrial two-layered fabric of the present invention will be described in detail with reference to the drawings.

The industrial two-layered fabric of the present invention comprises an upper surface side fabric comprising at least an upper surface side warp and at least an upper surface side weft, and a lower surface side fabric comprising at least a lower surface side warp and at least a lower surface side weft bound by at least an upper surface side biding yarn and at least a lower surface side biding yarn.

Said industrial two-layered fabric of the present invention is constituted by at least first pair of warps in which the upper surface side warp and the lower surface side warp are vertically arranged, at least second pair of warps in which the upper surface side binding yarn functioning as a binding yarn and the lower surface side binding yarn functioning as a binding yarn are vertically arranged, and at least third pair of warps in which two upper surface side warps are adjacently arranged.

Here, the upper surface side binding yarn functioning as a binding yarn is the one which functions as a binding yarn due to the fact that the warp which should constitute an upper surface side warp, in view of the arrangement and the structure of the warps in the complete structure of the industrial two-layered fabric, is woven with the lower surface side weft from the lower surface side, while the lower surface side binding yarn functioning as a binding yarn is the one which functions as a binding yarn due to the fact that the warp which should constitute an lower surface side warp, in view of the arrangement and the structure of the warps in the complete structure of the industrial two-layered fabric, is woven with the upper surface side weft from the upper surface side.

In addition, in the present invention, the one of the two upper surface side warps constituting the third pair of warps is woven with the upper surface side weft which should constitute a lower surface side warp, in view of the arrangement and the structure of the fabric, to form the upper surface side fabric.

Such being the case, in the industrial two-layered fabric, the number of the upper surface side warps of the fabric gets larger than that of the low surface side warps due to the fact the third pair of warps is incorporated into an essential element, so that the surface density becomes increased, whereby an excellent permeability is maintained, while at the same time, an excellent surface and a permeability almost same as those of the inventions disclosed in the Patent Publication 2 can be obtained.

Further, the sticking of the fibers into the fabric can be restricted due to the fact that the warps emerging on the surface of the first and second pairs of warps and the third pairs of warps, so that the requirement for the fabric, such as the lateral rigidity, the diagonal rigidity, and the sheet supportability can be fulfilled at a high level.

In addition, said industrial two-layered fabric of the present invention further comprises at least an auxiliary weft which is not exposed to a surface of the fabric. Since such an auxiliary weft is arranged inside the fabric without being woven with any warp and being bent or folded in the lateral direction of the fabric, the rigidity of the fabric can be improved, while the curling of the fabric in the widthwise direction can be restricted. Such excellent effects are attained neither by the invention disclosed in the Patent Publication 2, nor by the conventional fabric.

Further, said industrial two-layered fabric of the present invention may be preferably formed by the complete structures of the upper surface side fabric and the lower surface side fabric being woven with each other in the plain weaving.

In the present invention, the complete structure is defined to be a minimum unit forming the fabric structure, so that the fabric is formed by this unit being repeated in front and in rear, and right and left as well. A knuckle is defined to be a portion of a warp exposed on surface by passing over or below one or more wefts. A crimp is defined to be a long float of a weft formed on a surface by passing over or below a plurality of wefts.

Although the plain surface weaving structure is adopted in the present invention, a weft with a large or a small diameter can be used. In the conventional industrial two-layered fabric, if the weft with a large diameter is used as the the plain surface weaving structure, the surface density gets low. However, in the present invention, since the warps are included by the first pair of warps, the second pair of warps, and the third pair of warps, the surface density can be enhanced, even if the weft with a large diameter is adopted as the lower surface side weft, while the weft with a diameter smaller than that of the lower surface side weft is adopted as the upper surface side weft. In addition, if the weft with a large diameter is adopted as the upper surface side weft, while the weft with a diameter smaller than that of the upper surface side weft is adopted as the lower surface side weft, the permeability can be improved.

More specifically, the difference of the diameter between the upper surface side weft and the lower surface side weft may be preferably set to be within ±20% of the diameter of the upper surface side weft. If the difference of the diameter between the upper surface side weft and the lower surface side weft gets beyond 20% of the diameter of the upper surface side weft, the balance of the wire can be deteriorated, so that it becomes technically difficult to form a loop. In said industrial two-layered fabric of the present invention, the permeability and the surface smoothness can be adjusted by the difference of the diameter between the upper surface side weft and the lower surface side weft being set to be within ±20% of the diameter of the upper surface side weft.

The material of the yarns used for the industrial fabric of the present invention can be freely selected in accordance with the characteristics desired for the industrial fabric, and is not limited to the specific material.

The configuration of the yarn includes, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

Since the yarn constituting the fabric for unwoven fabric generally includes a high rigidity, polyester monofilaments with excellent dimension stability may be preferably adopted.

In addition, in the present invention, at least a portion of or all of said first pair of warps may be formed by carbon line, in a case where the non-woven fabric is produced, the wire can be electrically born due to a static electricity. In such a case, since the electrically born wire and the non-woven fabric can repulse with each other, the non-woven fabric cannot be produced on the wire. Such being the case, the static electricity can be removed from the wire by the fact that a portion of or all of said first pair of warps may be formed by carbon line. In this connection, a case in which the carbon line is used for the yarn other than the warp of the first pairs of warps (the upper surface side or lower surface side wefts, for instance) is not excluded from the scope of the present invention.

The diameter of the yarn constituting the fabric is not limited, in particular, but the diameter of upper surface side warp and the upper surface side weft constituting the upper surface side layer may be preferably comparatively small in order to make the fabric surface fine and smooth. In addition, since the lower surface contacts the machine, or the roll, so that the rigidity and the wear resistance are needed, the diameter of lower surface side warp and the lower surface side weft constituting the lower surface side layer may be preferably comparatively large. The value of these diameters may be selected, in accordance with the application, the circumstance for use, and the ratio of the number of the upper wefts to the lower wefts.

In addition, the industrial two-layered fabric of the present invention may be preferably endless in a loop joint manner by ends portion in the warp direction being joined.

In the loop joint, a loop forming portion can be formed with at least one weft being left at the end portion of the fabric. In addition, in the loop forming portion, the loop is formed by a portion of, or all of the warps of one end portion, or opposite ends portion of the fabric being folded or bent to form a joining loop appropriately woven with the wefts. Alternatively, a common hole thorough which a core wire is introduced below the weft with mating with a plurality of loops.

Now, the embodiments of the present invention will be described below with reference to the drawings. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

In each of the design views, the warp is indicated by a reference number such as 1,2, while the weft is indicated by a reference number such as 1', . . . 4'. The upper and lower warps are indicated by the reference number to which U and L are attached, respectively, such as 1'U, 2'L. The binding yarn which binds the upper surface side fabric and the lower surface side fabric with each other is indicated by a number adding b thereto. Further, the auxiliary weft is indicated a number adding S thereto.

In each of the design views, a symbol "▲" indicates that the yarn of the third pair of warps which should constitute a lower surface side warp is arranged above the upper surface side weft and the auxiliary weft, a symbol "X" indicates that the upper surface side warp is arranged above the upper surface side wefts and the auxiliary wefts, a solid square symbol "■" indicates that the upper surface side binding yarn functioning as a binding yarn in the second pair of warps is arranged above the upper surface side wefts and the auxiliary wefts, an open square symbol "□" indicates that the upper surface side binding yarn functioning as a binding yarn is arranged below the lower surface side wefts and the auxiliary wefts, a symbol "◆" indicates that the lower surface binding yarn functioning as a binding yarn is arranged above the upper surface side wefts and the auxiliary wefts, a symbol "◇" indicates that the lower surface binding yarn functioning as a binding yarn is arranged below the lower surface side wefts and the auxiliary wefts, and a symbol "○" indicates that the lower surface side warp is arranged below the lower surface side wefts and the auxiliary wefts. An overlapping portion of the wefts in the design view is expressed by the number indicating a yarn at the left portion in the design view.

The upper surface side warps and the lower surface side warps are overlapped in the vertical direction to form an on-stack structure.

First Embodiment

Figure 2:
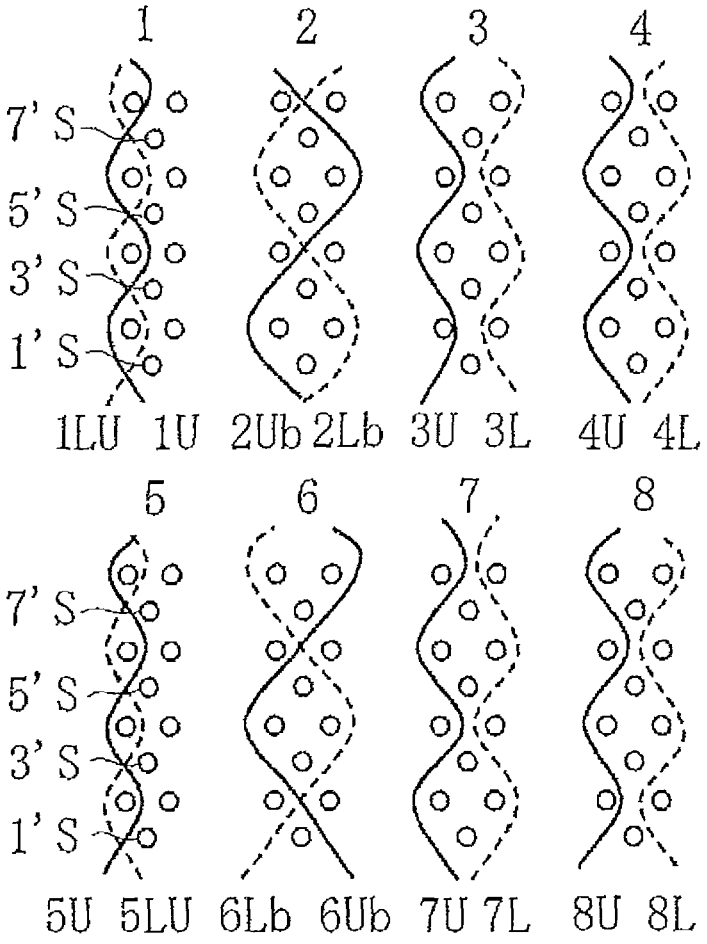
FIG. 2 is a cross section view taken along the warp of the first embodiment.

FIG. 1 is design view showing a complete structure of the industrial two-layered fabric of first embodiment according to the present invention. FIG. 2 is a cross section view taken along the warp in FIG. 1.

The industrial two-layered fabric of first embodiment shown in FIG. 1 is a two-layered fabric by the plain weaving constituted by first pairs of warps (3U and 3L, 4U and 4L, 7U and 7L, 8U and 8L), second pairs of warps (2Ub and 2Lb, 6Ub and 6Lb), third pairs of warps (1U and 1LU, 5U and 5LU), upper surface side wefts (2' U, 4' U, 6' U, and 8' U), lower surface side wefts (2' L, 4' L, 6' L, and 8' L), and auxiliary wefts (1' S, 3' S, 5' S, and 7' S).

As shown in FIG. 2, the upper surface side warp 1 U of the third pairs of warps passes over the auxiliary weft 1' S, the upper surface side weft 2' U and the auxiliary weft 3' S to form an upper surface side knuckle, and then, passes below the upper surface side weft 4' U and passes over the auxiliary weft 5' S, the upper surface side weft 6' U and the auxiliary weft 7' S to form another upper surface side knuckle again. In addition, the upper surface side warp 1 LU of the third pairs of warps which should inherently constitute the lower surface side warp passes below the upper surface side weft 2' U and passes over the auxiliary weft 3' S, the upper surface side weft 4' U and the auxiliary weft 5' S to form an upper surface side knuckle, and then, passes below the upper surface side weft 6' U and passes over the auxiliary weft 7' S and the upper surface side weft 8' U and the auxiliary weft 1' S again to form an another upper surface side knuckle.

The upper surface side warp 5 U of the third pairs of warps passes over the auxiliary weft 7' S, the upper surface side weft 8' U and the auxiliary weft 1' S to form an upper surface side knuckle, and then, passes below the upper surface side weft 2' U and passes over the auxiliary weft 3' S, the upper surface side weft 4' U and the auxiliary weft 5' S to form another upper surface side knuckle again. In addition, the upper surface side warp 5 LU of the third pairs of warps passes over the auxiliary weft 1' S, the upper surface side weft 2' U and the auxiliary weft 3' S to form an upper surface side knuckle, and then, passes below the upper surface side weft 4' U and passes over the auxiliary weft 5' S and the upper surface side weft 6' U and the auxiliary weft 7' S again to form an another upper surface side knuckle.

In addition, the upper surface side binding yarn 2Ub of the second pairs of warps passes over the auxiliary weft 1' S, the upper surface side weft 2' U and the auxiliary weft 3' S to form an upper surface side knuckle, and then, passes below the upper surface side weft 4' U, the auxiliary weft 5' S, the lower surface side weft 6' U and the auxiliary weft 7' S to bind the upper surface side fabric to the lower surface side fabric.

In addition, the lower surface side binding yarn 2Lb of the second pairs of warps passes below the auxiliary weft 1' S, the lower surface side weft 2' L and the auxiliary weft 3' S, and then, passes over the auxiliary weft 5' S, the lower surface side weft 6' U and the auxiliary weft 7' S to form an upper surface side knuckle.

In addition, the upper surface side binding yarn 6Ub of the second pairs of warps passes below the auxiliary weft 1' S and the upper surface side weft 2' U, and then, passes over the auxiliary weft 3' S, the upper surface side weft 4' U and the auxiliary weft 5' S to form an upper surface side knuckle, and then, passes below the upper surface side weft 6' U, the auxiliary weft 7' S, the lower surface side weft 8' L to bind the upper surface side fabric to the lower surface side fabric.

In addition, the lower surface side binding yarn 6Lb of the second pairs of warps passes below the auxiliary weft 3' S, the lower surface side weft 4' L and the auxiliary weft 5' S, and then, passes over the auxiliary weft 7' S, the upper surface side weft 8' U and the auxiliary weft 1' S to form an upper surface side knuckle.

The upper surface side warps 5 U and 8U of the first pairs of warps pass below the upper surface side weft 2' U and pass over the upper surface side weft 4' U and pass below the upper surface side weft 6' U and passes over the upper surface side weft 8' U to form an upper surface side fabric.

The lower surface side warps 3L and 8L of the first pairs of warps pass over the lower surface side weft 2' L and pass below the lower surface side weft 4' L and pass over the lower surface side weft 6' L and passes below the lower surface side weft 8' L to form a lower surface side fabric.

The upper surface side warps 4 U and 7U of the first pairs of warps pass over the upper surface side weft 2' U and pass below the upper surface side weft 4' U and pass over the upper surface side weft 6' U and passes below the upper surface side weft 8' U to form an upper surface side fabric.

The lower surface side warps 4L and 7L of the first pairs of warps pass below the lower surface side weft 2' L and pass over the lower surface side weft 4' L and pass below the lower surface side weft 6' L and passes over the lower surface side weft 8' L to form a lower surface side fabric.

Figure 3:
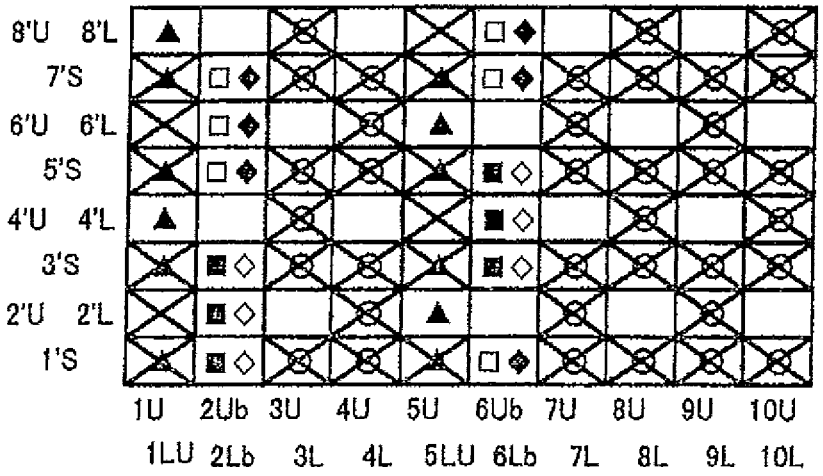
FIG. 3 is a design view showing a complete structure of the industrial two-layered fabric of the second embodiment according to the present invention.

Next, as shown in FIG. 3, the auxiliary wefts 1' S, 3' S, 5' S, and 7' S are not exposed to the surface of the fabric without being woven with the warps.

Since the industrial two-layered fabric of the first embodiment is constituted by the above structure, it improves sticking of the fabric and fulfills the requirements such as the lateral rigidity, the diagonal rigidity, and the sheet supportability. In addition, the industrial two-layered fabric of the first embodiment maintains good 通気性, while at the time keeps a good surface density on the upper surface side fabric.

Further, the industrial two-layered fabric of the first embodiment further improves its rigidity and restricts curling of the fabric in its widthwise direction.

Second Embodiment

Figure 4:
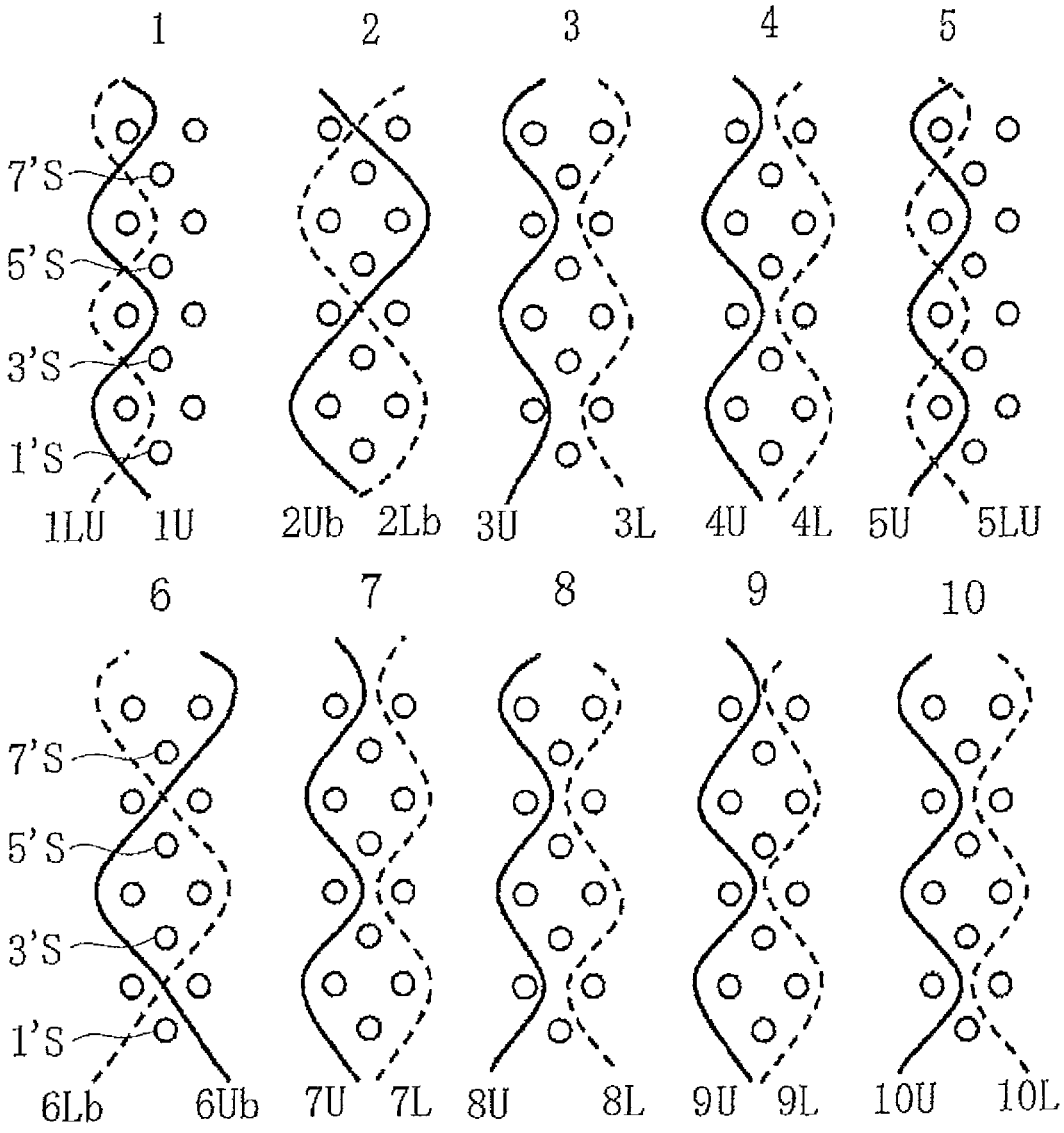
FIG. 4 is a cross section view taken along the warp of the second embodiment.

FIG. 3 is design view showing a complete structure of the industrial two-layered fabric of second embodiment according to the present invention. FIG. 4 is a cross section view taken along the warp in FIG. 3.

The industrial two-layered fabric of second embodiment shown in FIG. 3 is a two-layered fabric by the plain weaving constituted by first pairs of warps (3U and 3L, 4U and 4L, 7U and 7L, 8U and 8L, 9U and 9L, and 10U and 10L), second pairs of warps (2Ub and 2Lb, 6Ub and 6Lb), third pairs of warps (1U and 1LU, 5U and 5LU), upper surface side wefts (2' U, 4' U, 6' U, and 8' U), lower surface side wefts (2' L, 4' L, 6' L, and 8' L), and auxiliary wefts (1' S, 3' S, 5' S, and 7'S).

As shown in FIG. 4, the upper surface side warp 1 U of the third pairs of warps passes over the auxiliary weft 1' S, the upper surface side weft 2' U and the auxiliary weft 3' S to form an upper surface side knuckle, and then, passes below the upper surface side weft 4' U and passes over the auxiliary weft 5' S, the upper surface side weft 6' U and the auxiliary weft 7' S to form another upper surface side knuckle again. In addition, the upper surface side warp 1 LU of the third pairs of warps which should inherently constitute the lower surface side warp passes below the upper surface side weft 2' U and passes over the auxiliary weft 3' S, the upper surface side weft 4' U and the auxiliary weft 5' S to form an upper surface side knuckle, and then, passes below the upper surface side weft 6' U and passes over the auxiliary weft 7' S and the upper surface side weft 8' U and the auxiliary weft 1' S again to form an another upper surface side knuckle.

The upper surface side warp 5 U of the third pairs of warps passes over the auxiliary weft 7' S, the upper surface side weft 8' U and the auxiliary weft 1' S to form an upper surface side knuckle, and then, passes below the upper surface side weft 2' U and passes over the auxiliary weft 3' S, the upper surface side weft 4' U and the auxiliary weft 5' S to form another upper surface side knuckle again. In addition, the upper surface side warp 5 LU of the third pairs of warps passes over the auxiliary weft 1' S, the upper surface side weft 2' U and the auxiliary weft 3' S to form an upper surface side knuckle, and then, passes below the upper surface side weft 4' U and passes over the auxiliary weft 5' S and the upper surface side weft 6' U and the auxiliary weft 7' S again to form an another upper surface side knuckle.

In addition, the upper surface side binding yarn 2Ub of the second pairs of warps passes over the auxiliary weft 1' S, the upper surface side weft 2' U and the auxiliary weft 3' S to form an upper surface side knuckle, and then, passes below the upper surface side weft 4' U, the auxiliary weft 5' S, the lower surface side weft 6' U and the auxiliary weft 7' S to bind the upper surface side fabric to the lower surface side fabric.

In addition, the lower surface side binding yarn 2Lb of the second pairs of warps passes below the auxiliary weft 1' S, the lower surface side weft 2' L and the auxiliary weft 3' S, and then, passes over the auxiliary weft 5' S, the lower surface side weft 6' U and the auxiliary weft 7' S to form an upper surface side knuckle.

In addition, the upper surface side binding yarn 6Ub of the second pairs of warps passes below the auxiliary weft 1' S and the upper surface side weft 2' U, and then, passes over the auxiliary weft 3' S, the upper surface side weft 4' U and the auxiliary weft 5' S to form an upper surface side knuckle, and then, passes below the upper surface side weft 6' U, the auxiliary weft 7' S, the lower surface side weft 8' L to bind the upper surface side fabric to the lower surface side fabric.

In addition, the lower surface side binding yarn 6Lb of the second pairs of warps passes below the auxiliary weft 3' S, the lower surface side weft 4' L and the auxiliary weft 5' S, and then, passes over the auxiliary weft 7' S, the upper surface side weft 8' U and the auxiliary weft 1' S to form an upper surface side knuckle.

The upper surface side warps 3 U, 8 U and 10U of the first pairs of warps pass below the upper surface side weft 2' U and pass over the upper surface side weft 4' U and pass below the upper surface side weft 6' U and passes over the upper surface side weft 8' U to form an upper surface side fabric.

The lower surface side warps 3L, 8L and 10L of the first pairs of warps pass over the lower surface side weft 2' L and pass below the lower surface side weft 4' L and pass over the lower surface side weft 6' L and passes below the lower surface side weft 8' L to form a lower surface side fabric.

The upper surface side warps 4 U, 7 U and 9U of the first pairs of warps pass over the upper surface side weft 2' U and pass below the upper surface side weft 4' U and pass over the upper surface side weft 6' U and passes below the upper surface side weft 8' U to form an upper surface side fabric.

The lower surface side warps 4L, 7L and 9L of the first pairs of warps pass below the lower surface side weft 2' L and pass over the lower surface side weft 4' L and pass below the lower surface side weft 6' L and passes over the lower surface side weft 8' L to form a lower surface side fabric.

Next, as shown in FIG. 4, the auxiliary wefts 1' S, 3' S, 5' S, and 7' S are not exposed to the surface of the fabric without being woven with the warps.

The industrial two-layered fabric of the second embodiment improves the sticking of the fibers and fulfills the requirements such as the excellent lateral rigidity, the excellent diagonal rigidity, and the excellent sheet supportability by adopting the above structure. In addition, the industrial two-layered fabric of the second embodiment maintains the excellent permeability and the surface density on the upper surface side fabric. Further, the industrial two-layered fabric of the second embodiment maintains improves its rigidity and restricts the curling of the fabric in its widthwise direction.

EXPLANATION OF SYMBOLS

1U, 3U, 4U, 5U, 7U, 8U, 9U, 10U: upper surface side warp
3L, 4L, 5L, 7L, 8L, 9L, 10L: lower surface side warp
2Ub, 6Ub: upper surface side binding yarn
2Lb, 6Lb: lower surface side binding yarn
1LU, 5LU: upper surface side warps of the third pairs of the warps which should constitute the lower surface side warps, in view of the arrangement of the fabric
2'U, 4'U, 6'U, 8'U: upper surface side weft
2'L, 4'L, 6'L, 8'L: lower surface side weft
1'S, 3'S, 5'S, 7'S: auxiliary weft

What is claimed is:

1. An industrial two-layered fabric comprising an upper surface side fabric comprising at least an upper surface side warp and at least an upper surface side weft, and a lower surface side fabric comprising at least a lower surface side warp and at least a lower surface side weft bound by at least an upper surface side binding yarn and at least a lower surface side biding yarn, said industrial two-layered fabric is constituted by at least first pair of warps in which the upper surface side warp and the lower surface side warp are vertically arranged, at least second pair of warps in which the upper surface side binding yarn functioning as a binding yarn and the lower surface side binding yarn functioning as a binding yarn are vertically arranged, and at least third pair of warps in which two upper surface side warps are adjacently arranged, said industrial two-layered fabric further comprises at least an auxiliary weft which is not exposed to a surface of the fabric without being woven with any warp.

2. The industrial two-layered fabric according to claim 1, wherein a structure of each of the upper and lower surface side fabrics is constituted by a plain weaving.

3. The industrial two-layered fabric according to claim 1, wherein at least a portion of or all of said first pair of warps is formed by carbon line.

4. The industrial two-layered fabric according to claim 1, wherein ends in the warp direction of the industrial two-layered fabric are connected by a loop joint to form an endless configuration.

5. The industrial two-layered fabric according to claim 1, wherein the difference of the diameter between the upper surface side weft and the lower surface side weft is set to be within ±20% of the diameter of the upper surface side weft.

6. The industrial two-layered fabric according to claim 1, wherein a complete structure of the industrial two-layered fabric is formed by sixteen warps in which four sets of the first pair of warps, two sets of the second pair of warps and two sets of the third pair of binding yarns warps are included.

7. The industrial two-layered fabric according to claim 1, wherein a complete structure of the industrial two-layered fabric is formed by twenty warps in which six sets of the first pair of warps, two sets of the second pair of warps and two sets of the third pair of binding yarns warps are included.

* * * * *